United States Patent [19]

Iwase et al.

[11] Patent Number: 4,718,884

[45] Date of Patent: Jan. 12, 1988

[54] METHOD AND APPARATUS FOR FORMING A FILTER ELEMENT

[75] Inventors: Takatoshi Iwase, Anjo; Kouhei Hakamada, Toyota, both of Japan

[73] Assignee: Nippondenso Co., Ltd., Kariya, Japan

[21] Appl. No.: 893,083

[22] Filed: Aug. 4, 1986

[30] Foreign Application Priority Data

Aug. 12, 1985 [JP] Japan ..... 60-175654

[51] Int. Cl.[4] ..... B65H 45/20; B65H 45/16

[52] U.S. Cl. ..... 493/419; 493/451; 493/941

[58] Field of Search ..... 493/395, 405, 416, 419, 493/448, 451, 459, 463, 465, 466, 940, 941

[56] References Cited

U.S. PATENT DOCUMENTS

| | | | |
|---|---|---|---|
| 2,531,555 | 11/1950 | Cummings et al. | 493/941 |
| 2,709,950 | 6/1955 | Foster et al. | 493/451 |
| 2,984,160 | 5/1961 | Whelton et al. | 493/451 |
| 4,659,323 | 4/1987 | Ito et al. | 493/457 |

FOREIGN PATENT DOCUMENTS 1012534 12/1965 United Kingdom .

*Primary Examiner*—Frederick R. Schmidt
*Assistant Examiner*—William E. Terrell
*Attorney, Agent, or Firm*—Cushman, Darby & Cushman

[57] ABSTRACT

Apparatus and method for forming an axial flow filter element from a fan or sectorial shaped sheet having parallel curved ends, straight sides converging at an angle less than 180° and a plurality of curved ridges and valleys extending between the sides parallel to the curved ends. Holding wedges are inserted into the valleys in the upper side of the sheet while the latter is supported on a table. The pitch between the holding wedges is then reduced uniformly to reduce the radial length of the sheet. The sheet is then partially rounded into a semi-circular shape to increase the central angle of the sectorial shape sheet to as much as 180° by forcing the wider convex end of the reduced sheet toward a circular post centrally engaging the midpoint of the smaller concave end of the sheet. The partially rounded sheet, then is reformed to impart true circular arcs to the ridges and valleys by inserting reforming wedges into the valleys in one side of the sheet and sliding the wedges along those valleys along fixed predetermined circular arcs.

9 Claims, 10 Drawing Figures

METHOD AND APPARATUS FOR FORMING A FILTER ELEMENT

FIELD OF THE INVENTION

The present invention relates to an axial flow filter element which removes dust and other particles from air or oil. More especially the present invention relates to a method and apparatus for forming a semi-circular filter element from a fan or sectorial shaped sheet of filter material, e.g. non-texture cloth.

BRIEF DESCRIPTION OF THE CONVENTIONAL METHOD

The conventional method for forming a filter element is depicted in FIGS. 8(*a*)-(*c*), namely a sectorial shaped sheet 2 of non-texture cloth is combined with a fan or sectorial shaped wavy elastic film, such as thermoplastic polyethylene film 1 having alternating ridges and valleys extending between the straight sides parallel to the curved ends of the sector. Then the sheet 2 is conformed to the film 1 by hand as a first step (shown in FIG. 8(*a*)). Then the smaller concave end of the fan shaped wavy sheet 2 is engaged with a pin 3 which is fixed on a table, and the wavy sheet is rounded by hand in such a manner that both sides of the sheet are moved toward each other, as shown in FIG. 8(*b*). After that the sheet is completely rounded in order to abut both sides thereof against each other, as shown in FIG. 8(*c*). These hand manipulations shown in FIG. 8(*b*) and FIG. 8(*c*) are carried out as a second step.

SUMMARY OF THE INVENTION

These conventional steps described above, however, have a defect, e.g. requiring a long time to perform because of the resiliency of the sheet 2. Namely, it is very difficult to control the resiliency of the sheet 2 while the sheet 2 is rounded. According to the present inventors' experience, about thirty seconds are required to round the filter element when the final diameter thereof is about 300 mm, for example. Furthermore, since the filter element is produced by hand, product quality can not be maintained within a good range so that the pitch between adjacent ridges or valleys becomes irregular and hinders the filtering effect of the element.

The present invention has the object to provide an advanced automatic apparatus which produces a sectorial shaped wavy filter sheet with a central angle as large as 180°. In order to attain this object, the method of the present invention includes the following steps:

providing a fan or sectorial shaped sheet of filter material which has parallel curved ends, straight sides converging toward the smaller concave end and a plurality of uniformly spaced concentric arc-like wavy portions or curved corrugations, i.e. alternating arc-shaped ridges and valleys, extending between the sides parallel to the curved ends of the sheet;

holding or retaining the fan shaped sheet in its corrugated configuration by inserting a plurality of narrow curved holding wedges in and at the midlength of the valleys in one side of the sheet;

reducing the radial length of the sectorial corrugated sheet by uniformly reducing the pitch between adjacent holding wedges;

rounding the fan shaped corrugated reduced sheet until the central angle thereof becomes as large as 180° by forcing the convex end of the fan shaped sheet toward the concave end while the midlength of the latter is fixed in position; and reforming the shape of the corrugations of the rounded fan shaped sheet to true arcs of a circle by sliding reforming wedges along predetermined circular paths in the valleys in one side of the sheet.

DESCRIPTION OF THE PREFERRED EMBODIMENT

A preferred embodiment of the present invention is described hereinafter with reference to the drawings.

Figure 3:
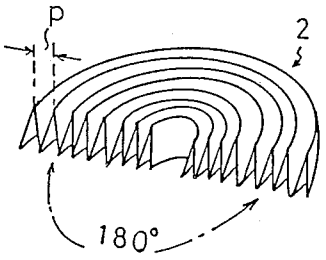
FIG. 3 is a perspective view of the final product of the apparatus shown in FIG. 1.
Figure 2:
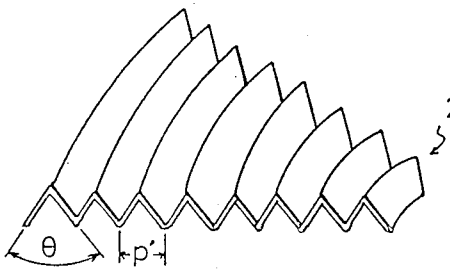
FIG. 2 is a perspective view of the sectorial shaped wavy sheet which is used in the apparatus shown in FIG. 1.
Figure 8A:
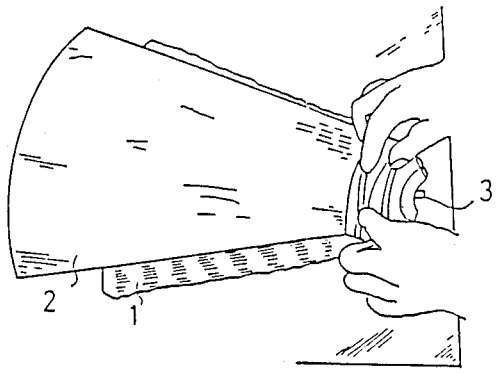
FIGS. 8(*a*)-8(*c*) are perspective views showing the steps for forming a filter element by the conventional method.
Figure 8B:
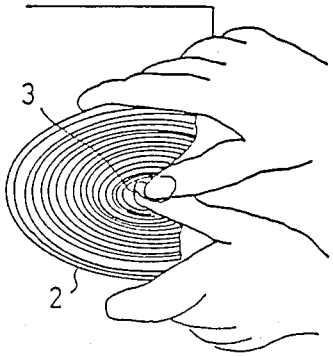
Figure 8C:
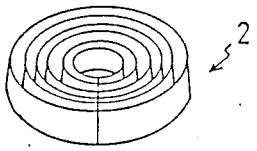

FIG. 2 shows a fan shaped sheet 2 of non-textured cloth which is used as the starting material in the apparatus of the present invention. This sheet 2 has been bent or creased to make a plurality of curved wavy portions, i.e. uniformly spaced alternating ridges and valleys extending between the straight sides parallel to the curved ends of the sheet. The angle between the sides of a valley preferably is about 90° with a predetermined pitch between ridges of p'. Apparatus and method for making wavy portions in a flat sectorial sheet is disclosed in U.S. Pat. No. 4,659,323. That sheet is then reduced in its radial length by the reducing step of the present invention and then rounded to make a semi-circular shaped element as shown in FIG. 3. After the sheet is rounded to a semi-circular shape, the sheet is then rounded further by another rounding machine (not shown) to attain a completely semi-circular shape as shown in FIG. 8(*c*).

Figure 1:
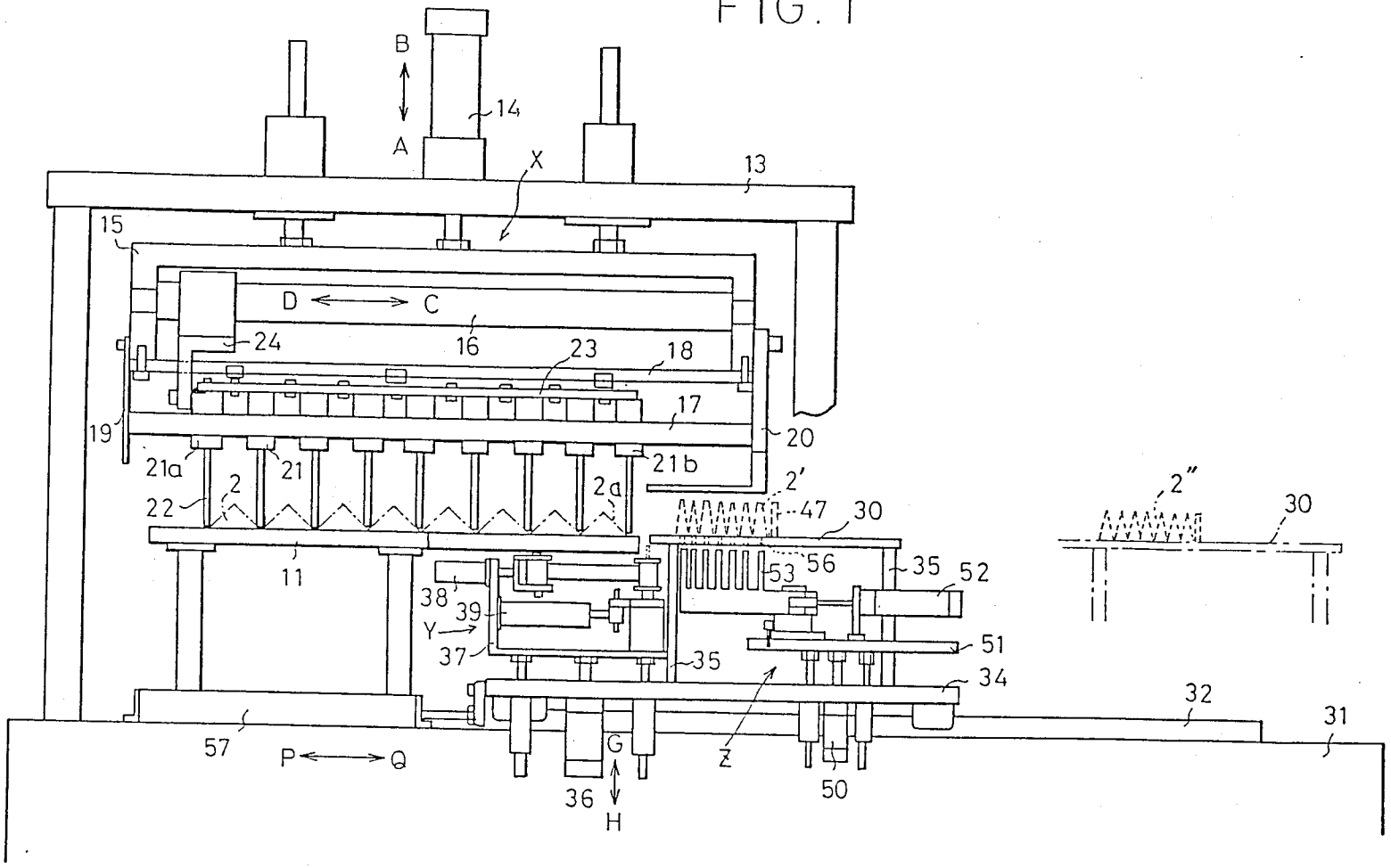
FIG. 1 is a schematic side view showing the apparatus of the present invention.

As shown in FIG. 1, the apparatus of this invention has a horizontal working table 11 for carrying the sheet 2 and movable reducing means X located under a fixed frame 13 which is above and parallel to the working table 11. The reducing means X has an elevating frame 15 that is carried and movable vertically by the rod of an upright cylinder 14 fixed to the frame 13. The elevating frame 15 also supports a rodless horizontal cylinder 16 and a rod 17 and a cam plate 18 below and parallel to the rodless cylinder 16. The rod 17 is supported by the elevating frame 15, via depending end brackets 19 and 20, and a plurality of pieces 21 are mounted to slide along the rod 17. Each sliding piece 21 carries a narrow arcuate holding wedge 22 at the lower end thereof which fits into, at the midlength of, a corresponding valley in the sheet 2 except the left most and right most wedges which engage the opposite ends of the sheet at the midlength thereof. Each sliding piece 21 is connected to a crossing pivot of a common pantograph 23 having an equal pitch between adjacent sliding pieces 21. The left most sliding piece 21*a* is connected with a slider 24 of the rodless cylinder 16. Accordingly, each sliding piece 21 and corresponding holding wedge 22 is moved while keeping a predetermined equal interval between the wedges when the slider 24 of the rodless cylinder 16 is moved in the C direction indicated by the double ended arrow C–D shown in FIG. 1.

When the slider 24 is so moved, the right most sliding piece 21*b* is not moved but maintains a fixed position until a predetermined shortening of the pantograph 23 as described hereafter. Since all the pieces 21 are connected with the pantograph 23, all the pieces left of the right side piece 21*b* travel rightward when the pantograph reduces the interval between adjacent pieces 21 as the left most piece 21*a* is moved to the right by the slider 24. After the pitch between the adjacent holding wedges is reduced to a predetermined pitch p (shown in FIG. 3) of the sheet 2, the distance between two rollers 25 carried on the side apices at the right most end of the pantograph becomes the same as the largest width M of the cam plate 18, so that the entire pantograph 23 and all the sliding pieces 21, including the right most piece 21*b*, start to move in the C direction.

At the right end of the table 11 and slightly spaced therefrom is an auxiliary working table 30 flush with the table 11. The table 11 has a central slot extending inward from the right hand end toward the left hand end. Disposed below the slot and the small gap between the tables 11 and 30 is rounding means Y which can be elevated to prevent the right hand concave edge 2*a* of the sheet 2 from dropping into the gap between the tables 11 and 30 as the sheet is moved off the table 11 onto the table 30 as described hereinafter.

Figure 5:
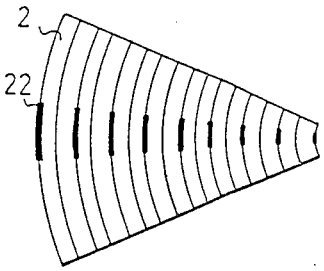
FIG. 5 is a plan view showing the shape of the holding wedges and their relationship with the valleys in one side of the sheet shown in FIG. 2.

As shown in FIG. 5, the cross-sectional shape of the holding wedges 22 is a short arc shape in order to fit the arc-shaped valleys and end edges of the sheet 2, and the width of the holding wedges 22 gradually reduce from the larger curved end toward the smaller concave end of the sheet 2. Namely, the width of the right hand holding wedge 22 is smaller than that of the left hand holding wedge 22 as shown in FIG. 5. The pitch of the holding wedges 22 initially should be the same as the pitch p′ of the wavy portions of the sheet 2 as shown in FIG. 2. The pitch p′, of course, can be varied according to variations of the configuration and dimensions of the sheet 2.

Figure 4:
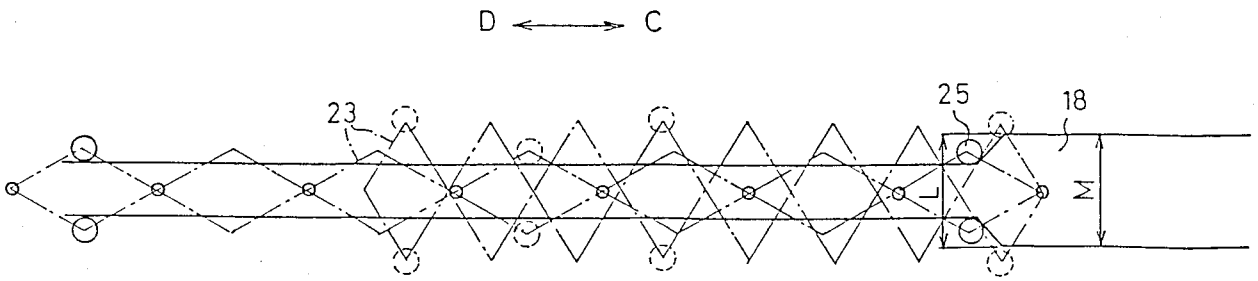
FIG. 4 is a schematic view showing the relationship between the pantograph and the cam plate of the apparatus shown in FIG. 1.

The operation of the reducing means is explained hereinafter. First, the fan shaped sheet 2 which has wavy portions, as shown in FIG. 2 is placed on the working table 11 with the smaller concave end 2*a* to the right as shown in FIG. 1. Then, the elevating frame 15 is moved downward (the direction A indicated by the double ended arrow A–B in FIG. 1) by the cylinder 14. The rodless cylinder 16, the rod 17, the sliding pieces 21 and the holding wedges 22 are also moved downward with the elevating frame 15, so that the lower end portions of the intermediate holding wedges 22 are inserted into the valleys of the wavy portions for holding the sheet 2 on the working table 11, as shown in FIG. 1. At the same time the left and right end wedges 22 respectively engage the larger convex and smaller concave ends of the sheet 2. Then the rodless cylinder 16 begins to move the slider 24 in the C direction shown in FIG. 1. The movement of the slider 24 causes all the holding wedges 22, except the right most which is held against moving by engagement of the rollers 25 with shoulders on the cam plate 18, to move rightward and thus reduce the radial length of the sheet 2, i.e. the distance between the convex and the concave ends. Such movement also reduces the pitch between the ridges in the sheet 2 until the pair of rollers 25 (FIG. 4) move apart a distance sufficient to embrace the wide part M of the cam plate 18. At that time the right hand wedge 22 moves together with all the others so that the reduced sheet is pushed off of the table 11 to a predetermined position 2′ on the table 30.

The sheet 2 on the auxiliary working table 30 is then rounded. The rounding means Y is disposed below the working table 11 when inoperative or stowed and raised to an operative or working position above the auxiliary working table 30 only when required. The rounding means Y is mounted on a slide base 34 which slides on a pair of rails 32 via slide bearings 33. The rails 32 are mounted on a base 31. The auxiliary working table 30 also is mounted on the slide base 34 via columns 35. An upright cylinder 36 mounted to and below the slide base 34 has its rod fastened to a sub-base 37 of the rounding means Y to raise and lower the latter (in the directions G and H indicated by the double ended arrow in FIG. 1) between its inoperative and operative positions.

Figure 6:
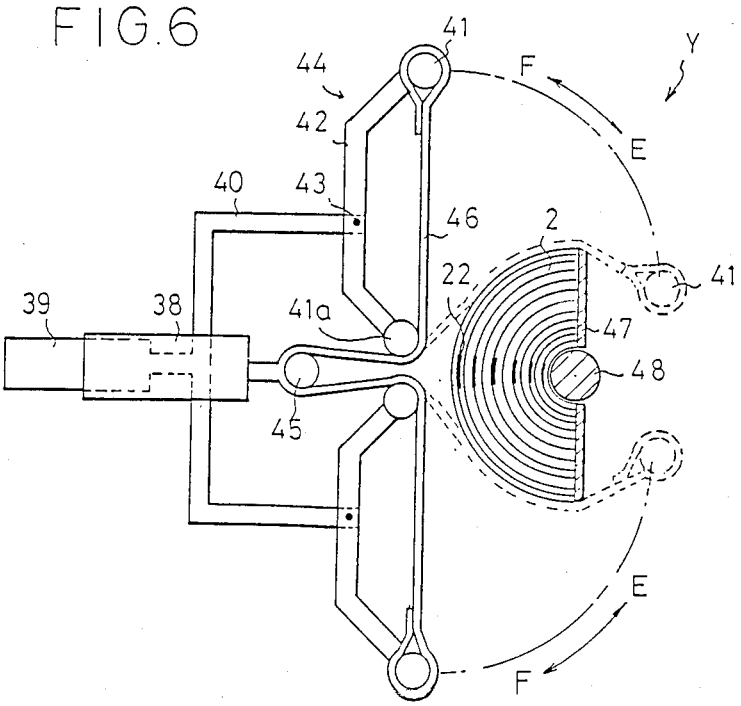
FIG. 6 is a plan view showing the main structure of the rounding means of the apparatus shown in FIG. 1.

The main structure of the rounding means Y is shown in FIG. 6. The rounding means Y has a pair of horizontal upper and lower cylinders 38 and 39, respectively, which are fixed to the sub-base 37. A U-shaped bracket 40 is fixed on the end of the rod of the lower cylinder 39, and a pair of links 42, on the ends of which rollers 41 and 41*a* are provided, are pivotally connected at their midpoints to the ends of the bracket 40, as at 48, so that the bracket 40, a link 42 and its pivot pin 43 make an arm 44. A rotor 45 is mounted to the end of the rod of the upper cylinder 38. The ends of a belt 46 are secured to the two rollers 41 with the intermediate portion of the belt 46 being trained over the rollers 41*a* and 45 as shown in FIG. 6.

The operation of the rounding means will now be explained. After a reduced sheet 2 is moved onto the auxiliary working table 30, the rounding means Y is raised by the cylinder 36 to its operative or working position. After that, the cylinder 39 extends its rod to move the arms 44 to the right and cause the links 42 to rotate and the rollers 41 to move in a curved path in the direction E indicated by the double ended arrows E–F in FIG. 6. This movement of the rollers 41 makes the belt 46 engage the convex edge of the sheet 2 and constrict and partly round it as shown by the dotted lines in FIG. 6.

A two-part upright stop plate 47, which engages the sides of the partly rounded sheet, limits the central angle of the partly rounded sheet 2, and an upright pin 48 which engages the midpoint of the concave edge of the sheet 2, are mounted on the auxiliary working table 30, as best shown in FIG. 6. Since the rollers 41 travel beyond the stop plate 47, the convex edge of the sheet 2 is pressed by the belt 46 and the sheet is partly rounded until the central angle of the sheet 2 becomes as large as 180°. During the pressing and rounding operation of the belt 46, the tension force of the belt 46 is controlled by movement of the rod of the cylinder 38, and the tension force of the belt 46 is modified in accordance with the number of ridges and valleys in the sheet.

Figure 7:
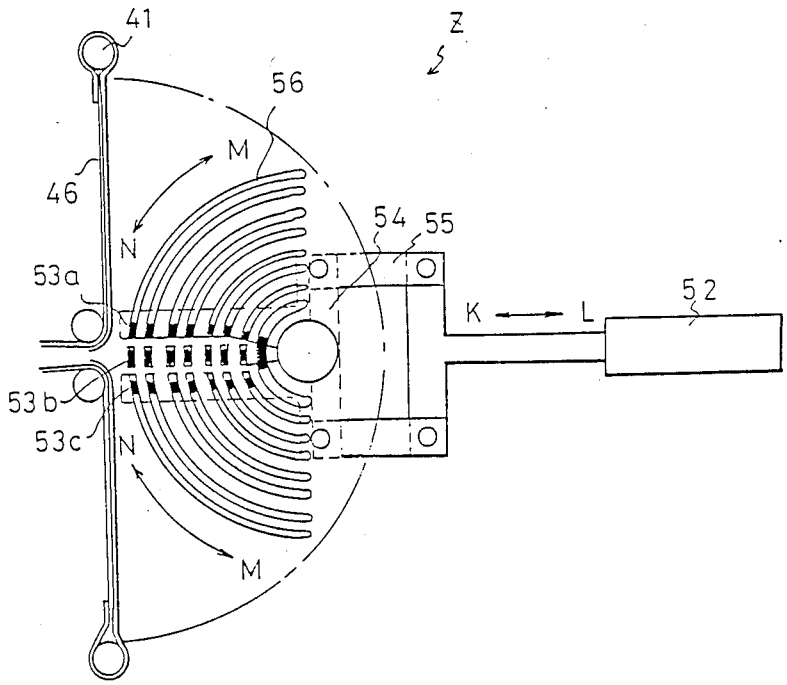
FIG. 7 is a plan view showing the main structure of the reforming means of the apparatus shown in FIG. 1.

After that, the sheet is reformed in order to make the shape of the wavy portions more truly circular. The reforming means Z is located under the auxiliary working table 30. As shown in FIG. 1, the reforming means Z, like the rounding means Y, has a vertical cylinder 50 mounted to and beneath the slide base 34. A sub-base 51 is mounted to the end of the rod of the cylinder 50, and a horizontal cylinder 52 mounted to and above the sub-base 51. As shown in FIG. 7, a holder 54 is connected to the end portion of the rod of the cylinder 52 via a bracket 55. The holder 54 has three parts which carry sets of upright aligned reforming wedges 53*a*, 53*b* and 53*c*, respectively. The reforming wedges of each set 53*a*, 53*b* and 53*c* are so arranged that the pitch therebetween is the same as the pitch of the wavy portions of the sheet which has already been partly rounded. The center set of wedges 53*b* is movable only vertically by the cylinder 50. The parts carrying the reforming wedges 53*a* and 53*c* located at right side and left side of the center reforming wedges 53*b* are, on the other hand, linked with the holder 54 in such a manner that both sets of the reforming wedges 53*a* and 53*c* are rotated in opposite directions away from the center set of wedges 53*b*, i.e. in the directions M indicated by the double ended arrows M–N in FIG. 7, when the holders 54 is moved by the cylinder 52.

A plurality of arcuate slots 56, which are aligned with and serve as guides for the sets of reforming wedges 53*a* and 53*c* during their rotations are provided in the auxiliary working table 30. The valleys in the underside of the partly rounded sheet are aligned with these slots 56.

The operation of this reforming means Z is now described. The sets of reforming wedges 53 are elevated from their lower position through the slots 56 by operation of the cylinder 50, so that the top of the reforming wedges 53 are inserted into the valleys in the underside of the sheet 2. At the same time, the holding wedges 22 which had retained the form of the sheet 2 start to move up, by movement of the frame 15, for returning to their starting position. Then the cylinder 52 moves the bracket 55 in the direction K indicated by the double ended arrow K–L in FIG. 7 and such movement makes the parts of the holder 54 carrying the wedge sets 53*a* and 53*c* rotate clockwise and counterclockwise respectively. Such rotation moves the wedge sets 53*a* and 53*c* in true circular arcs along the valleys in the underside of the partly rounded sheet to correspondingly shape such valleys.

After that the reforming wedges 53 are withdrawn downward from the sheet 2, the rollers 41 retracted and the rounding means Y and reforming means Z returned to their lower inoperative positions. The table 30 carrying the reformed sheet 2 then is moved to the position "2'''", shown in dotted lines in FIG. 1 by operation of a cylinder 57 which is connected to the left side of the slide base 34 in order to carry the reformed semi-circular sheet 2 to the next station (not shown) where it is made completely circular.

According to the present invention a portion of the process for forming a filter element which has heretofore been done manually can be performed automatically. Furthermore, the operation of the reforming wedges not only forms the ridges and valleys into true arcs but also makes the density of the filter element more uniform. The method and also the apparatus of the present invention obviously can be adapted for use to form filter elements having different sizes and/or different numbers of ridges and valleys.

We claim:

1. Method for forming a filter element, the steps comprising:

providing a sectorial-shaped sheet of filter material having parallel curved ends, straight sides converging at an included angle of less than 180° toward the smaller concave end and curved alternating uniformly spaced ridges and valleys extending between the sides parallel to the ends;

inserting a holding wedge in and at substantially the mid-length of each of the valleys in one side of the sheet and against and at substantially the mid-length of each end while the sheet is supported from below;

reducing the length of said sheet along a radius of the ends located midway between the sides by simultaneously uniformly reducing the pitch between adjacent holding wedges;

partially rounding the reduced sheet so that the included angle of the sides increases to substantially 180° by forcing the larger convex end of the sheet toward generally the mid-length of the smaller concave end while such mid-length is fixed in position and while said reduced length is substantially maintained; and reforming the ridges and valleys of the partially rounded sheet to substantially true arcs of a circle by moving reforming wedges along predetermined paths conforming to a true arc of a circle while the wedges are inserted in and slide along respective valleys in one side of the sheet while the latter is retained in place.

2. The method defined in claim 1 wherein the reducing step is carried out by moving all the holding wedges, except the wedge positioned against the smaller concave end, toward the latter wedge while it is fixed in position.

3. Apparatus for forming a filter element comprising:

a first working table for supporting a sectorial-shaped sheet of filter material having parallel curved ends, straight sides converging toward the smaller concave end with an included angle less than 180° and alternating uniformly spaced curved ridges and valleys extending between the sides parallel to the ends;

means for reducing the length of the sheet along a radius of the ends located midway between the sides including a plurality of holding wedges insertable in and at the mid-length of the valleys in the upper side of the sheet and at the mid-length and against the ends of the sheet while it is supported on said table and means for uniformly reducing the pitch between adjacent of said holding wedges while the wedge positioned against the smaller end is fixed in position;

a second working table adjacent said first table for receiving the reduced sheet;

means for partially rounding the reduced sheet while supported on said second table into a semi-circular shape having an included angle of substantially 180°, including an upright circular post mounted to said second table and engageable with and at the mid-length of the smaller concave end of the sheet, means for engaging a belt with the larger convex end of the sheet and forcefully partially wrapping said belt thereabout while the smaller end is engaged with said post to reduce the radii of curvature of both ends, and upright stop plate means supported on said second table on opposite sides of said post and engageable by the sides of the sheet to limit the included angle of the partly rounded sheet to not more than substantially 180°; and means for reforming the shape of the ridges and valleys of the partially rounded sheet into true arcs of a circle while the sheet is partially embraced by said belt including a plurality of reforming wedges insertable into the valleys in the underside of the sheet, means for sliding said wedges along said valleys and means for guiding each of said wedges along a predetermined path conforming substantially to a true arc of a circle.

4. The apparatus defined in claim 3 wherein the length reducing means includes a pantograph to which the holding wedges are connected.

5. The apparatus defined in claim 4 including a cam plate engageable by follower means on the pantograph to release the latter for translational movement, together with all of the holding wedges, to move the length reduced sheet onto the second table.

6. The apparatus defined in claim 3 wherein the rounding means further includes a pair of pivoted arms to which the ends of the belt are connected and a cylinder connected to said arms to pivot them so that said belt wraps about the larger convex end of the reduced sheet.

7. The apparatus defined in claim 3 wherein the guide means comprises arcuate slots in the second table and through which the reforming wedges extend.

8. The apparatus defined in claim 7 wherein there are three sets of reforming wedges, each set being aligned with a radius of the semi-circular sheet and including means for projecting said sets from an inoperative stowed position beneath the second table upward through the slots therein to an operative working position in the underside valleys of the semi-circular sheet with one set aligned with the mid-radius of the sheet and the other two positioned on the opposite sides thereof and for sliding said two sets in opposite directions while maintaining said one set fixed in position.

9. The apparatus defined in claim 3 wherein the first table has a slot in that end thereof where the smaller end of the sheet is positioned and including means for moving the rounding means from an inoperative stowed position below said first table upward through said slot to an operative position above said first table.

* * * * *